US009617746B1

(12) United States Patent
Francies, III

(10) Patent No.: US 9,617,746 B1
(45) Date of Patent: Apr. 11, 2017

(54) FORGED LIFT ANCHOR FOR PRECAST PORTLAND CEMENT CONCRETE SHAPES

(71) Applicant: Sidney E. Francies, III, Lithia, FL (US)

(72) Inventor: Sidney E. Francies, III, Lithia, FL (US)

(73) Assignee: Maestro International, LLC, Lithia, FL (US)

( * ) Notice: Subject to any disclaimer, the term of this patent is extended or adjusted under 35 U.S.C. 154(b) by 11 days.

(21) Appl. No.: 14/595,642

(22) Filed: Jan. 13, 2015

Related U.S. Application Data

(60) Provisional application No. 61/927,057, filed on Jan. 14, 2014.

(51) Int. Cl.

| | |
|---|---|
| ***E04G 21/12*** | (2006.01) |
| ***E04G 23/06*** | (2006.01) |
| ***E04G 21/14*** | (2006.01) |
| *E04G 21/16* | (2006.01) |
| *E04G 21/18* | (2006.01) |

(52) U.S. Cl.
CPC ..... *E04G 21/142* (2013.01); *E04G 21/12* (2013.01); *E04G 21/162* (2013.01); *E04G 21/1841* (2013.01)

(58) Field of Classification Search
CPC ..... E04G 21/12; E04G 21/142; E04G 21/162; E04G 21/1841; E04G 21/185; E04G 23/06; E04G 23/065
USPC ..... 52/122.1, 124.2, 125.1, 125.2, 125.5
See application file for complete search history.

(56) References Cited

U.S. PATENT DOCUMENTS

| | | | | |
|---|---|---|---|---|
| 3,236,019 | A * | 2/1966 | Ballou | 52/705 |
| 4,173,856 | A * | 11/1979 | Fricker | 52/125.5 |
| 4,290,638 | A * | 9/1981 | Manning | 294/89 |
| 4,367,892 | A * | 1/1983 | Holt | B66C 1/666 294/82.31 |
| 4,627,198 | A * | 12/1986 | Francies, III | 52/125.5 |
| 5,177,928 | A * | 1/1993 | Fricker | E04G 21/142 52/707 |
| 5,596,846 | A * | 1/1997 | Kelly | 52/125.2 |
| 5,651,911 | A * | 7/1997 | Pennypacker | 249/94 |
| 6,082,700 | A * | 7/2000 | Lancelot et al. | 249/91 |
| 6,568,730 | B1 * | 5/2003 | Paterson | 294/89 |
| 6,694,680 | B2 * | 2/2004 | Zambelli et al. | 52/125.2 |
| 7,441,375 | B2 * | 10/2008 | Lang | 52/125.5 |

(Continued)

*Primary Examiner* — Phi A
(74) *Attorney, Agent, or Firm* — McGarry Bair PC

(57) ABSTRACT

Precast Portland cement concrete shapes are handled by a lifting assembly comprising an elongate plate-like metallic lift anchor and a standard shear bar. The lift anchor defines a pair of parallel opposed planar faces, a medial longitudinal axis, and a plane of symmetry parallel to the planar faces. A lift head portion comprises a lift head through opening and shear flanges symmetrically disposed along the medial longitudinal axis. A proximal embedment portion comprises a shear bar through opening and a reinforcing bar through opening. A distal embedment portion terminates in a foot comprising a pair of distal flanges symmetrically disposed along the medial longitudinal axis, and a throat. The lift anchor is forged. The shear bar through opening is oblong along the medial longitudinal axis, and the standard shear bar is interconnectable with the shear bar through opening.

14 Claims, 7 Drawing Sheets

(56) References Cited

U.S. PATENT DOCUMENTS

| | | | | |
|---|---|---|---|---|
| 8,096,086 | B2 * | 1/2012 | Fletcher | B28B 23/005 52/124.2 |
| 8,677,697 | B2 * | 3/2014 | Eklund et al. | 52/125.4 |
| 8,764,084 | B2 * | 7/2014 | MacKay | E04G 21/142 294/82.35 |
| 8,898,964 | B1 * | 12/2014 | Francies, III | 52/125.4 |
| 8,966,834 | B2 * | 3/2015 | Sladojevic | 52/125.5 |
| 2008/0196324 | A1 * | 8/2008 | Mackay Sim | E04G 21/142 52/125.4 |
| 2013/0139451 | A1 * | 6/2013 | Sladojevic | 52/125.4 |
| 2013/0340357 | A1 * | 12/2013 | Recker et al. | 52/125.5 |
| 2015/0075090 | A1 * | 3/2015 | Barraclouch | E04G 21/147 52/125.4 |
| 2015/0101266 | A1 * | 4/2015 | Barraclough | E04G 21/142 52/125.4 |

* cited by examiner

FORGED LIFT ANCHOR FOR PRECAST PORTLAND CEMENT CONCRETE SHAPES

CROSS-REFERENCE TO RELATED APPLICATIONS

This application claims the benefit of U.S. Application No. 61/927,057, filed Jan. 14, 2014, which is incorporated by reference herein in its entirety.

BACKGROUND OF THE INVENTION

Field of the Invention

The invention relates generally to a forged lift anchor for precast concrete shapes. In one aspect, the invention relates to a forged lift anchor configured for coupling with shear bars that are selectively positionable to accommodate various conditions of shear loading.

Description of the Related Art

It is known to utilize precast Portland cement concrete shapes, such as panels and tees, at a construction project. Because these building elements may be very heavy, cranes, helicopters, and other heavy equipment may be used for handling and transportation.

Metal lift anchors may be integrated into building elements during precasting of the concrete. The lift anchors may be partly embedded in the shapes, and partly exposed for coupling with hooks, cables, chains, and other lifting and moving devices after the concrete has cured.

Handling and transportation of heavy concrete shapes invariably includes lifting the shapes utilizing embedded lift anchors. This may subject the lift anchors to high tensile loads that are, in turn, imposed on the concrete. Furthermore, Portland cement concrete generally has a low strength in tension, typically 10% to 15% of its compressive strength. Therefore, lifting operations may result in 1) failure of the anchor in tension, 2) pull-out of the anchor from the concrete, 3) failure of the concrete, or 4) a combination of one or more of these failure modes.

Referring to FIG. 1, a failure of Portland cement concrete in tension is illustrated, involving a large force 32 applied to a lift anchor 24. The force 32 may remove a portion of the concrete mass 12, with the lift anchor 24 remaining in the concrete. The illustrated known failure mode 10 may be characterized by a "shear cone" 14. Referring also to FIG. 2, the shear cone 14 may be defined for purposes of lift anchor evaluation as a right circular cone having a 45° shear angle $\alpha$ extending from the surface 16, 22 of the concrete 12 to a vertex 30 corresponding generally with the bottom of the lift anchor 24. The shear cone failure surface 28 may be characterized as an inclined surface centered about the lift anchor 24, 40, and reflected in a conically-shaped shear cavity 18.

Oblique loading 44 of an embedded lift anchor 24, 40, such as during tilting of a precast concrete panel from a horizontal position to a vertical position, may result in a tensile component 46 and a shear component 48 acting on the lift anchor 24, 40. These load components 46, 48 may vary in magnitude during a handling process. Thus, a lift anchor should have sufficient strength to accommodate anticipated loading configurations, yet be cost-effective and have suitable dimensions and weight to readily enable placement of the lift anchor and integration with other concrete reinforcing members. Additionally, a desire to handle heavier concrete shapes may dictate the use of larger, heavier, and/or a greater number of known lift anchors. This, too, may be inconsistent with optimal cost-effectiveness, and placement and integration of known lift anchors.

A need may therefore exist for a cost-effective lift anchor for precast concrete building shapes that exhibits a suitable strength and a compact configuration.

BRIEF DESCRIPTION OF THE INVENTION

Precast Portland cement concrete shapes are handled by a lifting assembly comprising an elongate plate-like metallic lift anchor and a standard shear bar. The lift anchor defines a pair of parallel opposed planar faces, a medial longitudinal axis, and a plane of symmetry parallel to the planar faces. A lift head portion comprises a lift head through opening and shear flanges symmetrically disposed along the medial longitudinal axis. A proximal embedment portion comprises a shear bar through opening and a reinforcing bar through opening. A distal embedment portion terminates in a foot comprising a pair of distal flanges symmetrically disposed along the medial longitudinal axis, and a throat. The lift anchor is forged. The shear bar through opening is oblong along the medial longitudinal axis, and the standard shear bar is interconnectable with the shear bar through opening.

DETAILED DESCRIPTION OF THE INVENTION

The following is a detailed description of exemplary embodiments of an assembly comprising a lift anchor and one or more shear bars, referred to hereinafter as "standard shear bars." The assembly may be configured for precast concrete construction, in particular the tilting of precast concrete shapes between a horizontal position and a vertical position. The lift anchor may be forged to increase its strength. The lift anchor configuration may be selected for compact integration with 1 or more standard shear bars and steel reinforcing elements, thereby enabling optimization of precast concrete shape dimensions and facilitating the sizing and placement of steel reinforcing elements. As used herein, the term "reinforcing element" may encompass prestressing wire bundles, steel reinforcing bars, and like steel reinforcing elements for Portland cement concrete.

It should be noted that several embodiments of the invention may be described and illustrated herein, and such embodiments may share certain features and/or functionalities. Once described, such shared features and/or functionalities may not be subsequently described herein except as necessary for a complete understanding of the invention. Furthermore, the embodiments disclosed herein may have different combinations of features and functionalities, and such embodiments may be considered exemplary. The embodiments are not intended to be construed in any way as limiting on the scope of the claims. Other combinations of features and functionalities may be evident to a person of ordinary skill in the relevant art, and the absence of any description of such a combination is not intended to be construed in any way as limiting on the scope of the claims.

Figure 1:
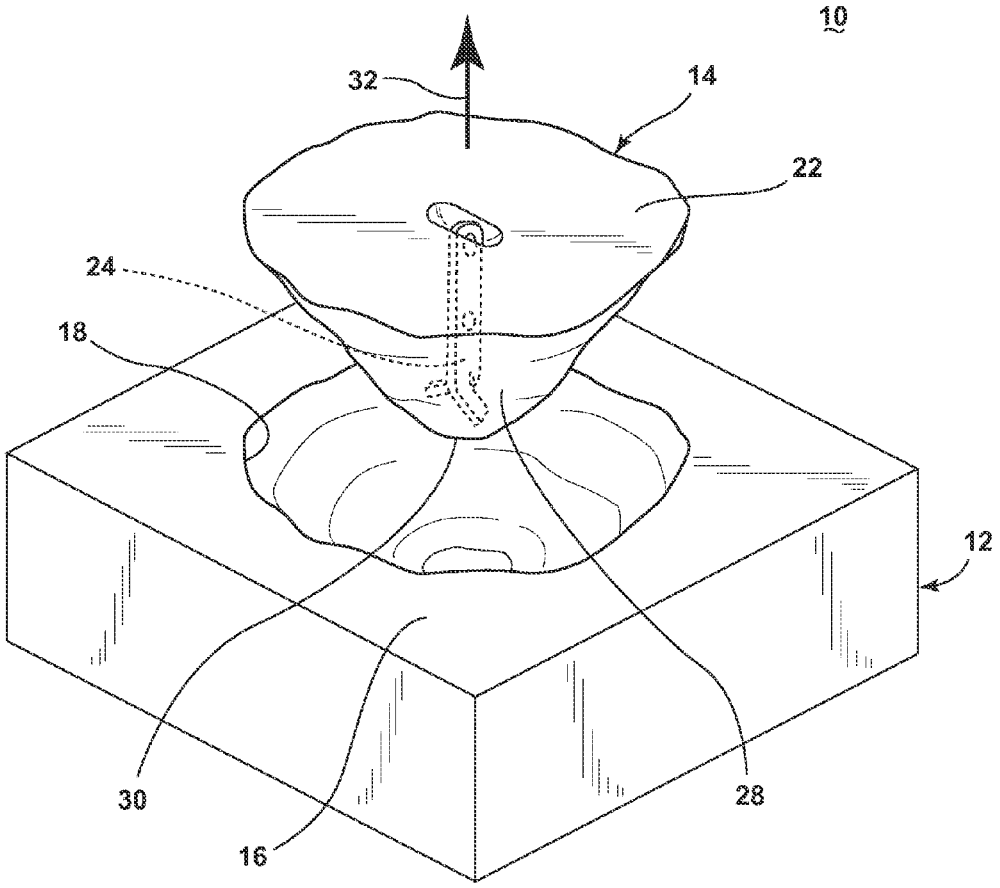
FIG. 1 (PRIOR ART)
FIG. 1 is a schematic exploded perspective view of a first prior art lift anchor embedded in a concrete shear cone removed from a concrete shape under a tensile load.
Figure 2:
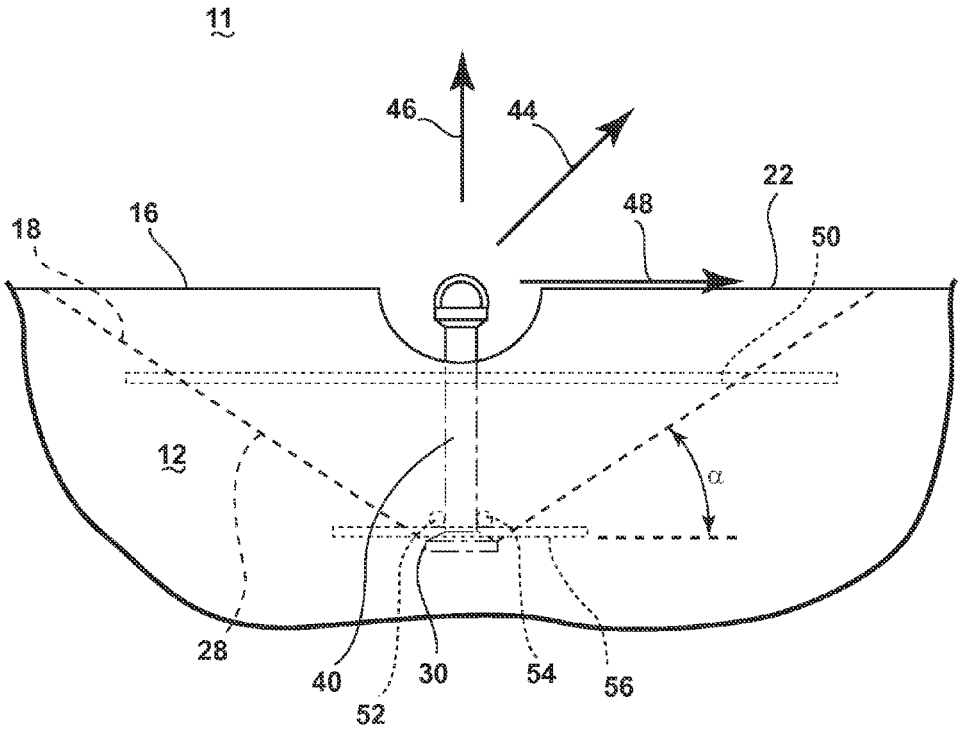
FIG. 2 (PRIOR ART)
FIG. 2 is a vertical side view of a portion of a Portland cement concrete shape with a second prior art lift anchor embedded therein subject to combined tensile and shear loading illustrating a shear cone and steel reinforcing elements.
Figure 3A:
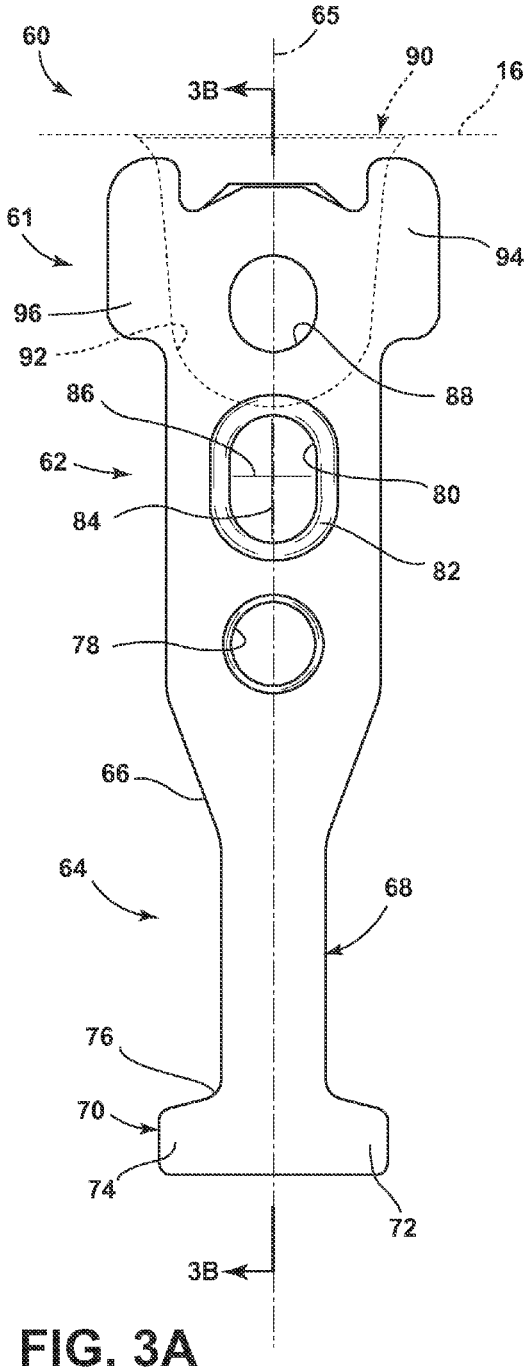
FIG. 3A is a vertical side view of an exemplary embodiment of a forged lift anchor according to the invention.
Figure 3B:
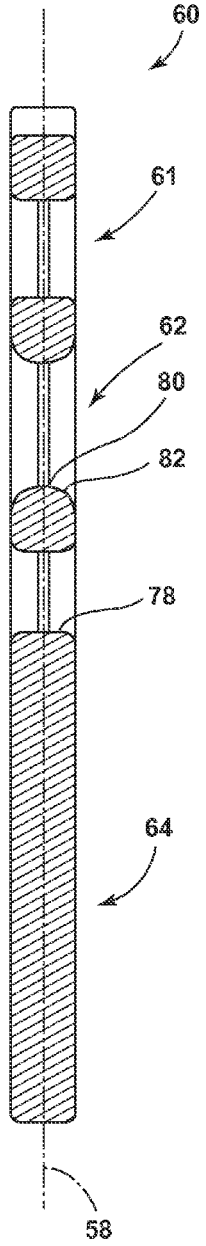
FIG. 3B is a sectional view of the forged lift anchor of FIG. 3A taken along view line 3B-3B.

Referring to the drawings, and particularly to FIGS. 3A and 3B, a forged lift anchor 60 for precast Portland cement concrete panels (not shown) according to an exemplary embodiment of the invention may be an elongate, platelike body characterized by a medial longitudinal axis 65 and a plane of bilateral symmetry 58. The medial longitudinal axis 65 may traverse a lift head portion 61, a proximal embedment portion 62, and a distal embedment portion 64. The plane of bilateral symmetry 58 may bisect the lift anchor 60 parallel to the planar faces of the lift anchor 60. The lift anchor 60 may be subject to heavy loading in the course of its use, and may thus be fabricated of a material having suitable properties, such as strength, elasticity, durability, corrosion resistance, and the like, for the purposes described herein.

The distal embedment portion 64 may be characterized by a somewhat rectangular foot 70 coupled with a throat 68. The foot 70 may be characterized by a pair of opposed shear flanges 72, 74 defining a concrete embedment terminus. The flanges 72, 74 may each transition into the throat 68 through a radial transition curve 76 having an arcuate profile.

The throat 68 may transition to the proximal embedment portion 62 through an oblique transition zone 66. A circular reinforcing element through opening 78 may begin at the section where the transition zone 66 ends, and the proximal embedment portion 62 begins. The through opening 78 may be sized for installation therethrough of a steel or iron reinforcing rod (not shown) having a generally circular cross-section.

An oblong shear bar opening 80 may be generally stadium-shaped or discorectangular, having a major axis 84 collinear with the medial longitudinal axis 65, and a minor axis 86 orthogonal to the medial longitudinal axis 65. The perimeter of the shear bar opening 80 may transition to the surface of the proximal embedment portion 62 through an annular curved surface 82. The annular curved surface 82 may have a radius of curvature equal to about ½ the thickness of the lift anchor 60. Thus, a 19 mm lift anchor thickness may define a radius of curvature equal to 0.35" or 9 mm. The perimeter of the reinforcing element through opening 78 may also transition to the surface of the proximal embedment portion 62 through an annular curved surface having a radius of curvature equal to about one half the thickness of the lift anchor 60. The radius of curvature of the perimeter of the shear bar opening 80 and the reinforcing element through opening 78 may increase or decrease as the thickness of the lift anchor 60 increases or decreases.

An insert cavity 92 may be formed in a precast Portland cement concrete shape during placement of the concrete so that the lift head portion 61 of the lift anchor 60 may be accessible. The insert cavity 92 may be formed by a recess insert 90, an exemplary outline of which is identified by broken lines. The proximal embedment portion 62 of the lift anchor 60 may transition to the lift head portion 61 in a section of the lift anchor 60 immediately adjacent the shear bar opening 80 and the recess insert 90 outline.

A lift head through opening 88 may be characterized as a generally circular opening in the lift head portion 61. The lift head through opening 88 may be located so that the recess insert 90 may enclose the lift head through opening 88 during placement of the concrete. After curing of the concrete, the lift head through opening 88 may be exposed in the insert cavity 92 for coupling with a lift assembly, including a known lift clutch (not shown).

A suitable material for the forged lift anchor 60 may be iron or steel. More specifically, a suitable steel may include a steel alloy meeting the specifications for Chinese grade 40Cr, or an equivalent. Grade 40Cr steel alloy may be considered a high-strength steel. The following secondary constituents added to iron, and their concentration ranges, have been established for grade 40Cr steel alloy:

| Chemical Composition of Grade Cr40 Steel Alloy (Wt. %) | | | | | | | |
|---|---|---|---|---|---|---|---|
| Carbon | Chromium | Silicon | Manganese | Nickel | Phosphorus | Sulfur | Copper |
| 0.37-0.44 | 0.81-1.10 | 0.17-0.37 | 0.50-0.80 | ≤0.030 | ≤0.035 | ≤0.035 | ≤0.030 |

The entire lift anchor 60 may undergo a hot forging process.

Shear bars may be incorporated with lift anchors to effectively increase the shear cone dimensions, thereby increasing the shear cone surface area. In an effort to increase the size of the shear cone, 12.7 mm (½") diameter smooth-surface shear bar stock may be bent into a central bow characterized by a radius bend of somewhat less than 19 mm (¾"), and a pair of coaxial opposed transverse shear arms, each transitioning away from the central bow through a 90°, 15 mm (0.6") radius bend.

Figure 4A:
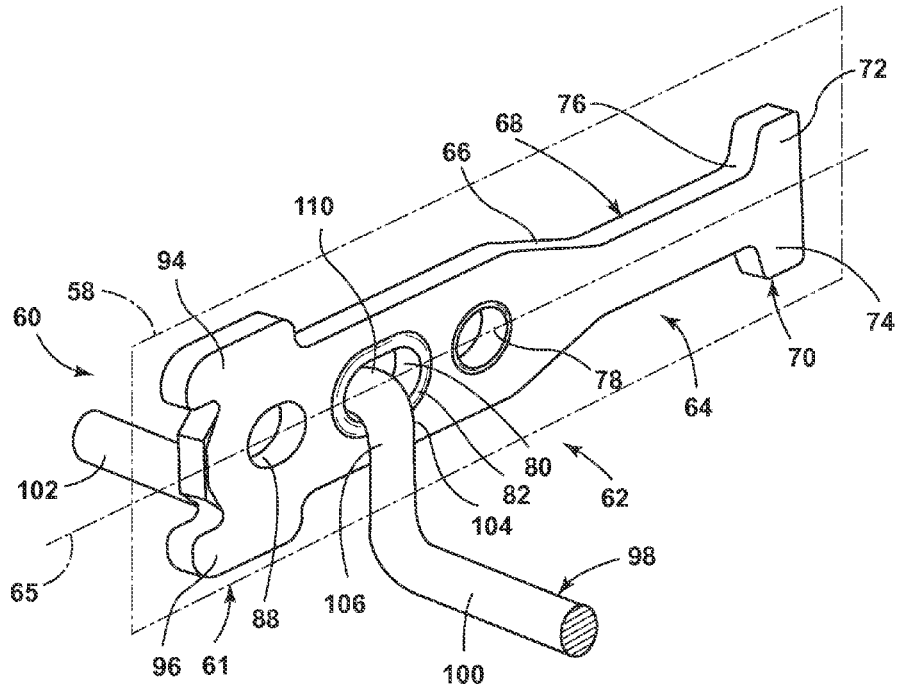
FIG. 4A is a perspective view of the forged lift anchor of FIG. 3A coupled with a standard shear bar according to a first exemplary embodiment of the invention.
Figure 4B:
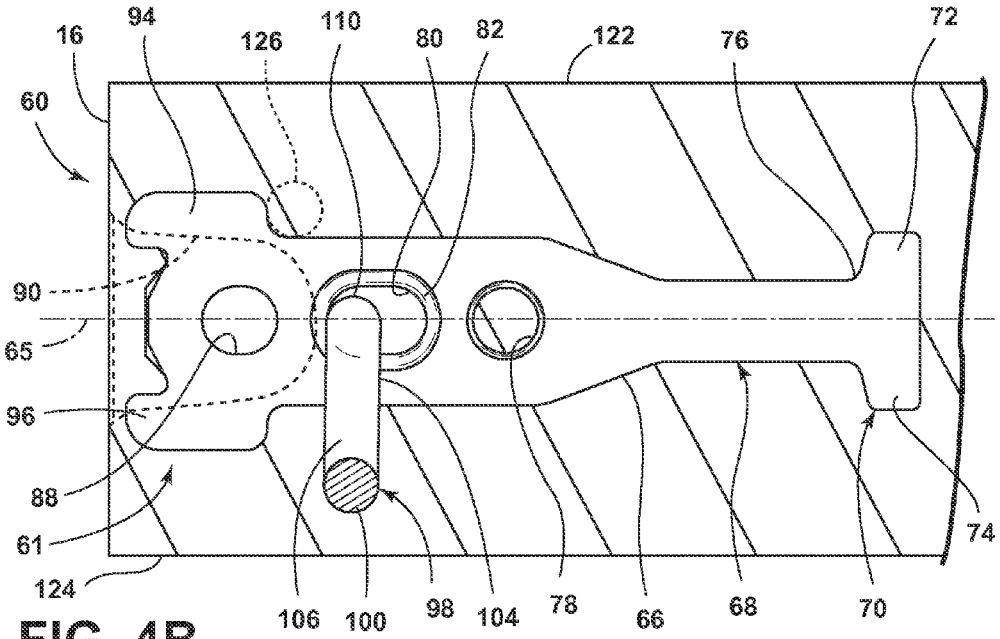
FIG. 4B is a horizontal side view of the forged lift anchor and standard shear bar of FIG. 4A, with an additional reinforcing element identified by a broken line, superimposed on an exemplary concrete slab, and illustrating the relative positioning thereof.

Turning now to FIGS. 4A and 4B, a standard shear bar 98 comprising smooth round bar stock may be characterized by a bent, somewhat U-shaped portion, transitioning transversely to a first shear arm 100 and an opposed, coaxially aligned identical second shear arm 102. The standard shear bar 98 may include a U-shaped bow 104 having a first bow leg 106 and a second bow leg 108 (FIG. 6B) transitioning to the shear arms 100, 102, respectively. The standard shear bar 98 may be bilaterally symmetrical about a plane, such as the plane of bilateral symmetry 58, from which the shear arms 100, 102 may orthogonally extend. The plane of bilateral symmetry 58 may bisect the bow 104 through a bow stationary point 110 (FIG. 6B).

The standard shear bar 98 may comply with specifications for grades Q235 and QL142F steel. Stock for the standard shear bar 98 may be initially drawn down from a larger diameter stock to a finished diameter of 19 mm. The 19 mm diameter stock may be subsequently bent to selected standard shear bar 98 dimensions, generally without heating the workpiece. The standard shear bar 98 may also undergo hot-dipped galvanization to provide corrosion protection.

The radii of the bends in the standard shear bar 98 may be selected in order to maximize standard shear bar strength, minimize standard shear bar size, and facilitate joining of the standard shear bar 98 with the lift anchor 60. The standard shear bar 98 may be joined to the lift anchor 60 by first inserting a shear arm 100, 102 orthogonally through the shear bar opening 80 so that an associated bow leg 106, 108 may be positioned immediately adjacent the lift anchor 60. The standard shear bar 98 may then be rotated relative to the lift anchor 60 so that the bow 104 between the bow legs 106, 108 may be slidably translated over the proximal embedment portion 62 separating the shear bar opening 80 from the side edge of the lift anchor 60, while the shear arm 100, 102 may be concurrently rotated in the shear bar opening 80 from the orientation orthogonal to the lift anchor 60 to an orientation parallel to the lift anchor 60. The bow 104 may then be rotated through the shear bar opening 80 so that the bow legs 106, 108 may be disposed on either side of the lift anchor 60 with the shear arms 100, 102 extending orthogonally away from the lift anchor 60.

The longitudinal and rotatable manipulation of the standard shear bar 98 in the shear bar opening 80 may be facilitated by the annular curved surface 82, which may reduce the potential for the standard shear bar 98 to catch on a shear bar opening having square edges, and which may enhance the slidability of the standard shear bar 98 along the shear bar opening 80. This may also enable shear bar bends with smaller radii.

Additional reinforcing members, such as a supplemental shear element 126, may be coupled with the lift anchor 60 based upon relevant factors, e.g. load considerations, dimensional constraints, and the like. The location of the supplemental shear element 126 is merely exemplary, and other locations along the lift anchor 12 may also be suitable.

Figure 5:
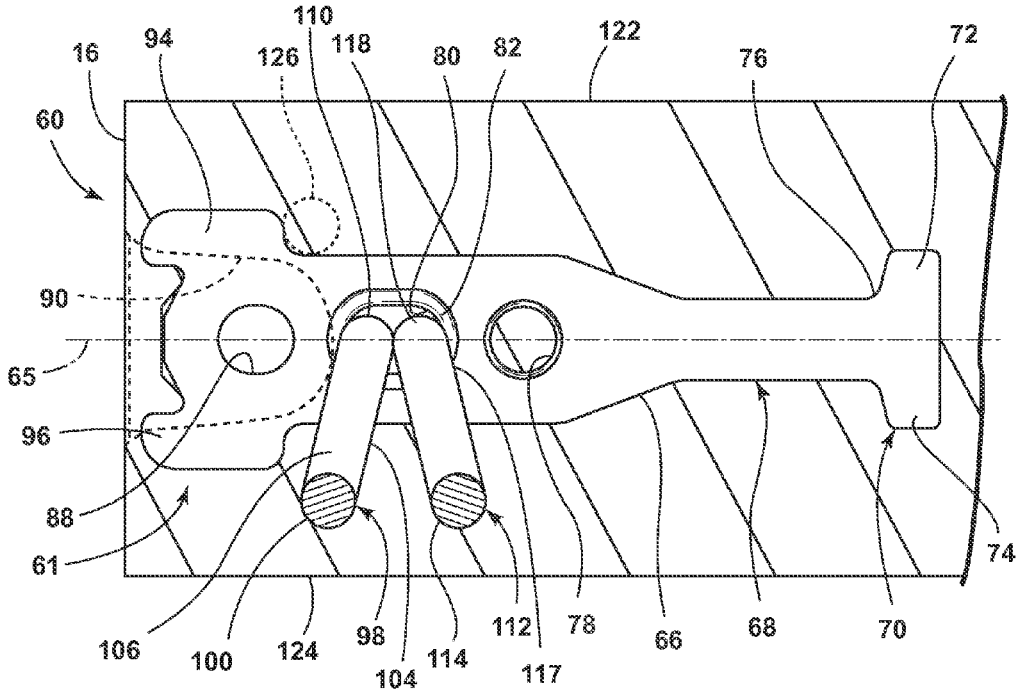
FIG. 5 is a horizontal side view of the forged lift anchor of FIG. 3A coupled with a pair of standard shear bars according to a second exemplary embodiment of the invention, with an additional reinforcing element identified by a broken line, superimposed on an exemplary concrete slab, and illustrating the relative positioning thereof.

Turning now to FIG. 5, the shear bar opening 80 may accommodate a supplemental standard shear bar 112 identical to the standard shear bar 98, comprising transverse shear arms 114, 116, a bow, and a bow stationary point 118. The supplemental standard shear bar 112 may be similarly oriented, with respect to the lift anchor 60, as the standard shear bar 98. Both standard shear bars 98, 112 may be inserted through the shear bar opening 80 as previously described. The standard shear bars 98, 112 and shear bar opening 80 may be configured so that the major axis 84 of the shear bar opening 80 may be somewhat greater than twice the diameter of the standard shear bars 98, 112.

As illustrated in FIG. 5, the standard shear bars 98, 112 may be rotated away from one another so that the transverse shear arms, e.g. 100 and 114, may be separated a preselected distance. The separation of the transverse shear arms 100, 114 may increase the size of a theoretical shear cone associated with the lift anchor and shear bar assembly, thereby developing an increased resistance to pullout of the lift anchor 60, and increased shear strength for lifting of concrete shapes.

Additional reinforcing members, such as the supplemental shear element 126, may be coupled with the lift anchor 60 based upon relevant factors, e.g. load considerations, dimensional constraints, and the like. The location of the supplemental shear element 126 is merely exemplary, and other locations along the lift anchor 12 may also be suitable.

Figure 6A:
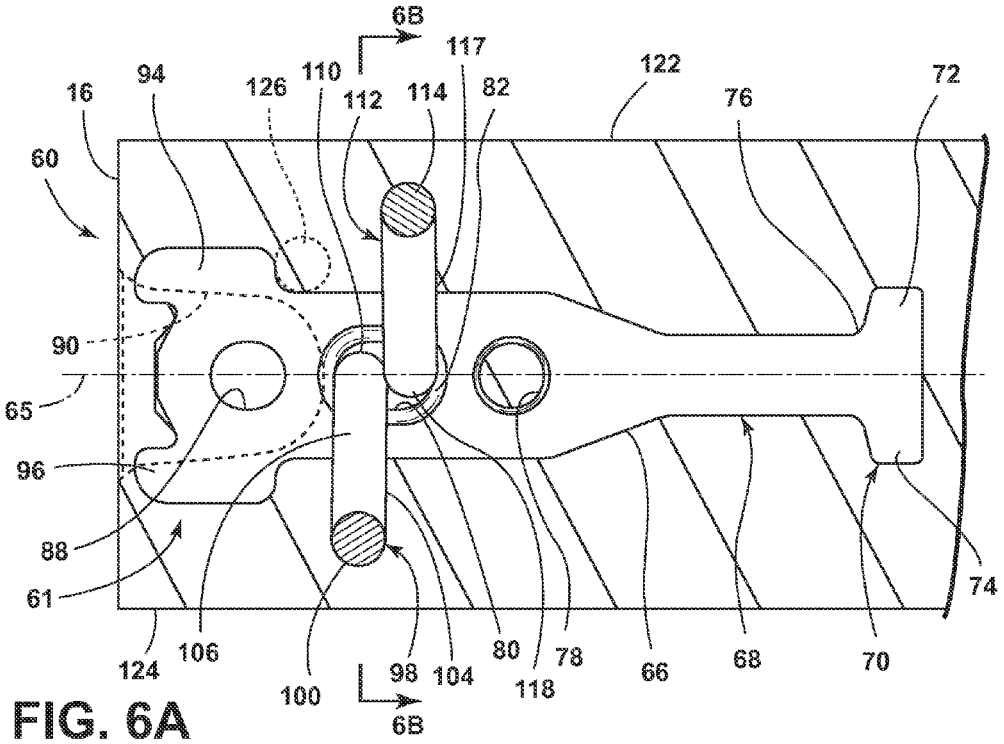
FIG. 6A is a horizontal side view similar to FIG. 5 of the forged lift anchor coupled with a pair of standard shear bars according to a third exemplary embodiment of the invention, with an additional reinforcing element identified by a broken line, superimposed on an exemplary concrete slab, and illustrating the relative positioning thereof.
Figure 6B:
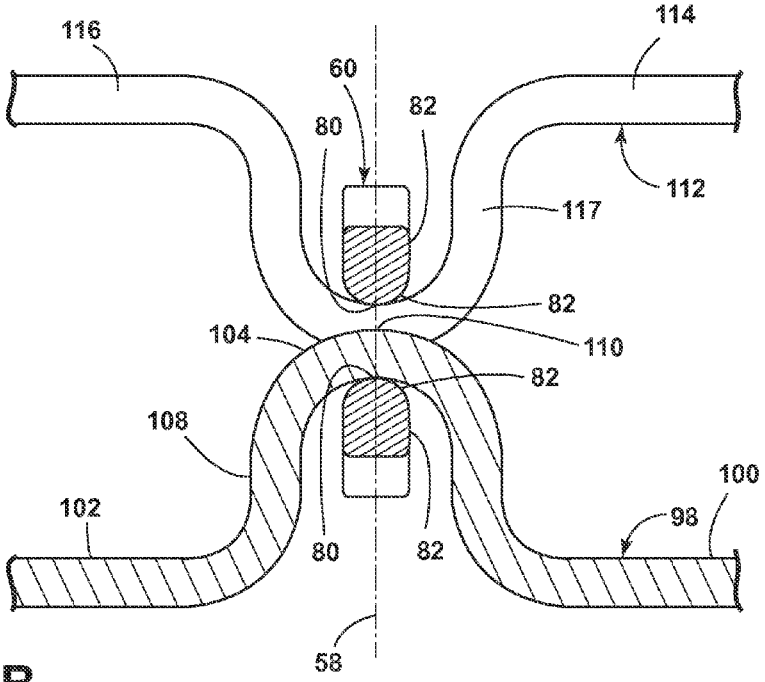
FIG. 6B is a sectional view of the forged lift anchor and standard shear bars of FIG. 6A taken along view line 6B-6B.

Turning now to FIGS. 6A and 6B, an alternative embodiment of the assembly illustrated in FIG. 5 may comprise the standard shear bars 98, 112, but with the standard shear bar 98 oriented downwardly and the supplemental standard shear bar 112 oriented upwardly. Both standard shear bars 98, 112 may be inserted through the shear bar opening 80 as previously described. Additional reinforcing members, such as the supplemental shear element 126, may be coupled with the lift anchor 60 based upon factors, e.g. load considerations, dimensional constraints, and the like. The location of the supplemental shear element 126 is merely exemplary, and other locations along the lift anchor 12 may also be suitable. This orientation of the standard shear bars 98, 112 and the supplemental shear element 126 may provide increased resistance to shear loading, including in different directions, e.g. orthogonal to the medial longitudinal axis 65, parallel to the medial longitudinal axis 65, and the like.

Figure 7:
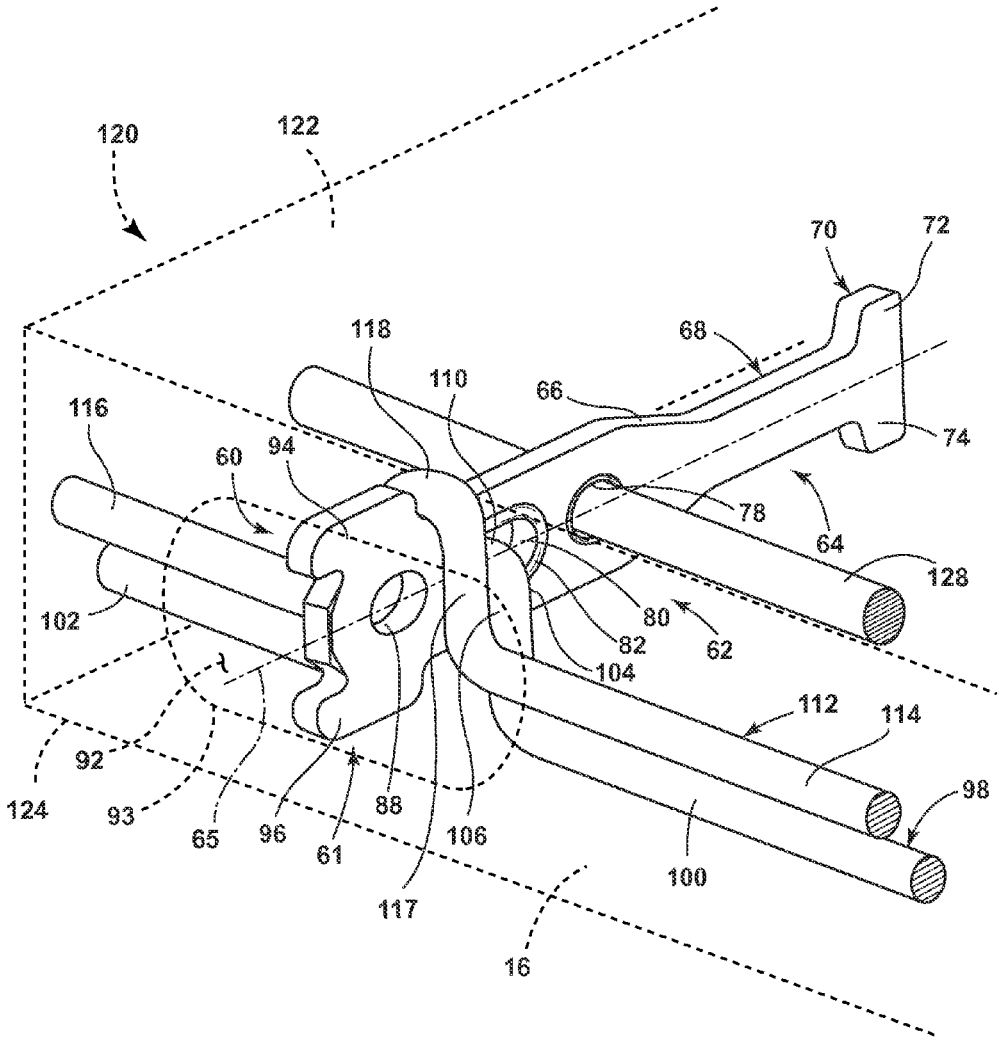
FIG. 7 is a perspective view of the forged lift anchor and standard shear bar of FIG. 4B, with a second standard shear bar and an additional reinforcing element disposed with the forged lift anchor, in a portion of a concrete slab, the concrete slab identified by broken lines.

FIG. 7 illustrates a concrete slab 120 having a first sidewall surface 122 and a parallel opposed sidewall surface 124 integrated with an assembly that may comprise the lift anchor 60, the standard shear bar 98 coupled with the shear bar opening 80, an optional reinforcing element 128 coupled with the reinforcing element opening 78, and the supplemental standard shear bar 112 cradled in an arcuate transition surface extending from the shear flange 94, 96 to the proximal embedment portion 62, rather than extending through the shear bar opening 80. The optional reinforcing element 128 and supplemental standard shear bar 112 may be diametrically bisected by the plane of bilateral symmetry 58. A large shear cone (not shown) may be characterized by an apex 30 defined in part by the transverse shear arms 100, 102, 114, 116, and the reinforcing element 128, as a result of the depth of embedment of the transverse shear arms 100, 102, 114, 116 and the reinforcing element 128, relative to the first sidewall surface 122.

Additional reinforcing members, such as the supplemental shear element 126, may be coupled with the lift anchor 60 based upon relevant factors, e.g. load considerations, dimensional constraints, and the like. Any illustrated location of shear elements is merely exemplary, and other locations along the lift anchor 60 may also be suitable.

Forging of the lift anchor fabricated of grade 40Cr steel alloy may increase the lifting capacity of the lift anchor to 11 tons. Alternatively, the enhanced strength of the 40Cr steel alloy may enable the use of smaller lift anchors in precast forms having thinner sections. The shear bar may be coupled with the lift anchor by passing the shear bar through the lift anchor, which may increase the lifting capacity in shear. Further increases in lifting capacity may be obtained by utilizing 2 shear bars in alternative configurations in order to control the size and location of the shear cone. The incorporation of the oblong through opening in the lift anchor may enable more effective coupling of the shear bars with the lift anchor.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A lifting assembly for handling precast Portland cement concrete shapes, the lifting assembly comprising:

an elongate metallic lift anchor characterized by a pair of parallel opposed planar faces, a medial longitudinal axis, and a plane of symmetry parallel to the planar faces, the lift anchor further characterized by a lift head portion comprising a lift head through opening for coupling with a lifting apparatus, and an opposed pair of shear flanges symmetrically disposed along the medial longitudinal axis to define a lift head width;

a proximal embedment portion below the lift head and defining a proximal embedment width, and comprising a shear bar through opening oblong along the medial longitudinal axis;

a distal embedment portion terminating in a foot characterized by a pair of laterally opposed distal flanges symmetrically disposed along the medial longitudinal axis and defining a distal embedment width, and a throat defining a throat width narrower than the distal embedment width; and at least two shear bars, each having a round cross section and a bilaterally symmetrical U-shaped bow transitioning transversely to a pair of opposed coaxially aligned shear arms;

wherein the at least two shear bars extend through the shear bar through opening with the bilaterally symmetrical U-shaped bows on the medial longitudinal axis and a coaxially aligned shear arm extending away from each planar face, the U-shaped bow having a radius selected to facilitate joining the at least two shear bars with the elongate metallic anchor and rotating the at least two shear bars within the shear bar through opening to adjust shear strength in a precast Portland cement concrete shape.

2. A lifting assembly according to claim 1 further comprising a reinforcing bar through opening wherein each of the shear bar through opening and the reinforcing bar through opening is bisected by the medial longitudinal axis.

3. A lifting assembly according to claim 1 wherein the shear flanges each join the proximal embedment portion at an arcuate transition surface adapted for contact with a reinforcing bar extending orthogonal to the plane of symmetry.

4. A lifting assembly according to claim 1 wherein the distal flanges each join the throat at a radial transition curve having an arcuate profile adapted for contact with a reinforcing bar extending orthogonal to the plane of symmetry.

5. A lifting assembly according to claim 1 wherein radii of the U-shaped bows are selected to maximize shear bar strength, minimize shear bar size, and facilitate extending the at least two shear bars through the shear bar through opening.

6. A lifting assembly according to claim 5 wherein the U-shaped bows are configured to rest on an annular curved surface at a perimeter of the shear bar through opening to the surface of the proximal embedment portion.

7. A lifting assembly according to claim 5 wherein both of the at least two shear bars are configured to extend through the shear bar through opening so that coaxially aligned shear arms extend orthogonally away from the lift anchor.

8. A lifting assembly according to claim 7 wherein the U-shaped bows are rotatable in the shear bar through opening to selectively orient the coaxially aligned shear arms in different planes.

9. A lifting assembly according to claim 7 further comprising a supplemental shear element.

10. A lifting assembly according to claim 1 wherein the perimeter of the shear bar through opening is characterized by an annular curved surface to the surface of the proximal embedment portion.

11. A lifting assembly according to claim 10 wherein the annular curved surface has a radius of curvature equal to one half the thickness of the lift anchor.

12. A lifting assembly according to claim 1 wherein the lift anchor is fabricated of high-strength steel.

13. A lifting assembly according to claim 1 wherein the lift anchor is fabricated of grade 40Cr steel alloy.

14. A lifting assembly according to claim 1 wherein the lift anchor is forged.

* * * * *